US009931643B2

(12) United States Patent
Huyghe et al.

(10) Patent No.: US 9,931,643 B2
(45) Date of Patent: Apr. 3, 2018

(54) DECANTER CENTRIFUGE WITH WEAR-RESISTANT ACCELERATOR INSERTS

(71) Applicant: ANDRITZ S.A.S., Velizy-Villacoublay (FR)

(72) Inventors: Jean-Marc Huyghe, Le Poinconnet (FR); Laurentiu Pasol, Paris (FR)

(73) Assignee: ANDRITZ S.A.S., Velizy-Villacoublay (FR)

( * ) Notice: Subject to any disclaimer, the term of this patent is extended or adjusted under 35 U.S.C. 154(b) by 0 days.

(21) Appl. No.: 15/180,574

(22) Filed: Jun. 13, 2016

(65) Prior Publication Data

US 2016/0368002 A1 Dec. 22, 2016

(30) Foreign Application Priority Data

Jun. 19, 2015 (EP) ..... 15172828

(51) Int. Cl.
*B04B 1/20* (2006.01)
*B04B 11/06* (2006.01)

(52) U.S. Cl.
CPC ..... *B04B 1/20* (2013.01); *B04B 11/06* (2013.01); *B04B 2001/2033* (2013.01)

(58) Field of Classification Search
CPC .... B04B 2001/2033; B04B 2001/2066; B04B 11/06; B04B 1/20
USPC ..... 366/52–54, 56, 84, 60; 210/377, 380.1, 210/380.3
See application file for complete search history.

(56) References Cited

U.S. PATENT DOCUMENTS 3,187,997 A * 6/1965 Gooch ..... B04B 1/20 494/53
3,228,592 A * 1/1966 Shapiro ..... B04B 1/20 494/51
3,368,747 A * 2/1968 Lavanchy ..... B04B 1/20 494/38
3,398,888 A * 8/1968 Koenecke ..... B04B 1/20 494/11
3,428,246 A * 2/1969 Finkelston ..... B04B 1/20 210/374
3,568,919 A * 3/1971 Nielsen ..... B04B 1/20 494/53

(Continued)

FOREIGN PATENT DOCUMENTS

DE 40 41 868 12/1990
EP 3106230 A1 * 12/2016 ..... B04B 1/20

*Primary Examiner* — Charles E Cooley
(74) *Attorney, Agent, or Firm* — Alix, Yale & Ristas, LLP

(57) ABSTRACT

A decanter centrifuge includes a rotatable bowl extending along a centrifuge axis of rotation, and a rotatable scroll conveyor with hub mounted coaxially within the bowl. A feed pipe passes centrally within the hub and leads into a feed chamber within the hub. A plurality of circumferentially spaced apart nozzles extend radially outward from a round internal wall of the feed chamber to the outside surface of the hub and extend radially inward beyond the internal wall of the feed chamber. A plurality of discrete accelerator inserts are mounted on the internal wall of the feed chamber, wherein each insert is adjacently mounted between two nozzles and each nozzle is circumferentially fixed by abutment with the radially inward extensions of two of the spaced apart nozzles.

17 Claims, 5 Drawing Sheets

(56) References Cited

U.S. PATENT DOCUMENTS 3,568,920 A * 3/1971 Nielsen ..... B04B 1/20 494/53
3,620,442 A * 11/1971 Halloran, Jr. ..... B04B 1/20 494/38
4,142,669 A * 3/1979 Burlet ..... B04B 1/20 494/53
4,714,456 A * 12/1987 Bender ..... B04B 1/20 494/36
5,374,234 A * 12/1994 Madsen ..... B04B 1/20 494/53
5,380,266 A 1/1995 Leung et al.
5,401,423 A 3/1995 Leung et al.
5,403,486 A 4/1995 Leung
5,971,907 A * 10/1999 Johannemann ..... B04B 1/20 494/37
6,024,686 A * 2/2000 Madsen ..... B04B 1/20 494/54
6,561,965 B1 * 5/2003 Corner-Walker ..... B04B 1/20 494/53
6,605,029 B1 * 8/2003 Koch ..... B04B 1/20 494/53
6,780,147 B2 * 8/2004 Koch ..... B04B 1/20 494/53
6,790,169 B2 * 9/2004 Koch ..... B04B 1/20 494/53
7,060,019 B2 * 6/2006 Hermeler ..... B04B 1/20 494/53
7,282,019 B2 * 10/2007 Lantz ..... B04B 1/20 494/53
7,862,493 B2 * 1/2011 Haider ..... B04B 1/20 494/53
9,266,122 B2 * 2/2016 Kjær ..... B04B 1/20
9,333,515 B2 * 5/2016 Reiff ..... B04B 1/20
2014/0005024 A1 1/2014 Reiff et al.
2017/0232453 A1 * 8/2017 Ando ..... B04B 15/06 494/27

* cited by examiner

DECANTER CENTRIFUGE WITH WEAR-RESISTANT ACCELERATOR INSERTS

BACKGROUND

The invention relates to a decanter centrifuge of the type having a scroll conveyor rotatable around a preferably horizontal axis of rotation mounted substantially concentrically within a rotating bowl.

Such systems are known from, e.g., U.S. Pat. No. 5,403,486. The system features scroll conveyor with a scroll hub including an inside surface and an outside surface, at least one passageway between the inside surface and the outside surface and a feed pipe in the center of the hub. A number of extensions form a multispray nozzle. This patent presents a rotating wash feed compartment to improve cake washing and an acceleration system of the feed by using U-shaped channels extending from the inside to the outside surface of a conveyor hub. The U-shaped channel communicates with an inwardly extending L-shaped baffle which opposes the Coriolis force. This design creates sudden feed acceleration by breaking particles or flocs and product accumulation behind baffles by reducing its effect quickly. The U-shaped channels extending to the outside of the conveyor has disadvantages in that the feed slurry is discharged in the pool in the form of concentrated jets which results in a remixing of already separated solids. As these channels are not filled full with liquid the air circulation is not well controlled because these kind of channels work as a fan by putting air under pressure. These systems are very complex and also tend to clog when a more sticky suspension is fed in.

US 2014/0005024 discloses a new feed chamber provided with a proximal cross wall, distal cross wall and wear resistance members which are extend on the all inner surface of the feed chamber. U.S. Pat. No. 3,568,920 presents a dismountable insert concerning a feed chamber for wear resistance. The raw materials are fed into the machine through a rotating feed pipe in a bushing feed chamber. The scroll is provided with an inner rotor fixed with bolts on the outside of scroll conveyor. It is possible to disassembly the inner rotor in order to change the bushing inserts. This scroll is complex to manufacture, the rotating feed pipe is difficult to seal and the nozzles of the feed chamber are not extended inside and outside of the feed chamber.

DE 40 41 868 shows a centrifuge with an insert for all the inside surface of the feed chamber made in one part for wear resistance. This cannot be replaced and this after this insert is worn the whole centrifuge scroll has to be dismantled and refurbished.

U.S. Pat. No. 5,380,266 shows a feed accelerator system with vanes inside a conical feed chamber is presented. This system improves the efficiency of the feed chamber by accelerating the product inside the feed chamber at the rotational speed of the scroll before to discharge in the pool of the centrifuge. Another accelerating system inside the feed chamber is presented in the U.S. Pat. No. 5,401,423.

A traditional decanter runs at high speed and the feeding of the machine is at zero rotational speed of the product. One of the difficulties is to bring the feed at the bowl speed with high efficiency, low shear rate (smooth acceleration to avoid breaking of particles or flocs) and without having important wear. During operation of a centrifuge wear may occur inside of the feed chamber and at the discharge ports. It is often necessary to carry out a cut of the scroll, a new welding and new balancing. Standard feed chambers are made for high hydraulic efficiency or wear protection or easy maintenance but not all these futures in the same time.

SUMMARY

The present invention is directed to an improved decanter centrifuge and to an improved feed chamber for a decanter centrifuge.

To avoid the disadvantages of the state of the art, the present invention features a number of nozzles extending from a distribution chamber inside of the scroll hub to the outside and a plurality of accelerator inserts on the inside surface of the distribution chamber, between the nozzles.

These inserts ensure a good and gradual acceleration of feed into the inlet nozzles and in addition provide an effective protection of the feed chamber wall. This arrangement with nozzles and accelerator inserts offers the possibility to effect repairs of the scroll directly on site in a short time. The disclosed distribution chamber feeds the scroll of the scroll conveyor, with high efficiency, smooth product acceleration, wear protection and easy maintenance. With such system it can be ensured that the wear is distributed over all inlet nozzles even.

An advantageous embodiment of the invention is characterized by the nozzles fixed on the hub of the scroll conveyor with bolts. They may be easily dismantled and also exchanged if necessary, e.g., when they are worn.

The accelerator inserts may have a curved or wave shaped form, may be made from polyurethane or may have a smooth surface.

In the disclosed embodiment, the decanter centrifuge comprises a rotatable bowl extending along a centrifuge axis of rotation with a rotatable scroll conveyor mounted coaxially within the bowl. The scroll conveyor includes a hub, a hub inside surface, a hub outside surface, and a helical winding along the outside surface. A feed pipe passes centrally within the hub and leads into a feed chamber within the hub. A plurality of nozzles extend radially outward from an internal wall of the feed chamber to the outside surface of the hub. In a key feature, a plurality of inserts are mounted on the internal wall of the feed chamber, each adjacently between two nozzles.

Each insert is mounted between the feed pipe and the nozzles such that all flow from the feed pipe to the nozzles passes along an internal surface of an insert.

Preferably, the feed chamber includes a conical acceleration chamber followed by a distribution chamber, and the nozzles and inserts are located in the distribution chamber. The distribution chamber is cylindrical, with an axial length, and each insert is mounted circumferentially on the internal wall of the distribution chamber between circumferentially spaced nozzles, with each insert having a length that is at least most of the axial length of the distribution chamber.

As directed to a feed chamber, the invention comprises a rotatable scroll conveyor including a hub and at least one helical winding, the hub including a feed chamber having an inside surface and an outside surface, and a feed pipe in the center of the hub leading to the feed chamber. A plurality of nozzles are spaced circumferentially in and extend from inside to outside of the feed chamber. Accelerator inserts are provided on the inside surface of the feed chamber circumferentially between the nozzles.

BRIEF DESCRIPTION OF THE DRAWING

Aspects of the invention will described below with reference to the accompanied drawing, in which.

DETAILED DESCRIPTION

Figure 1:
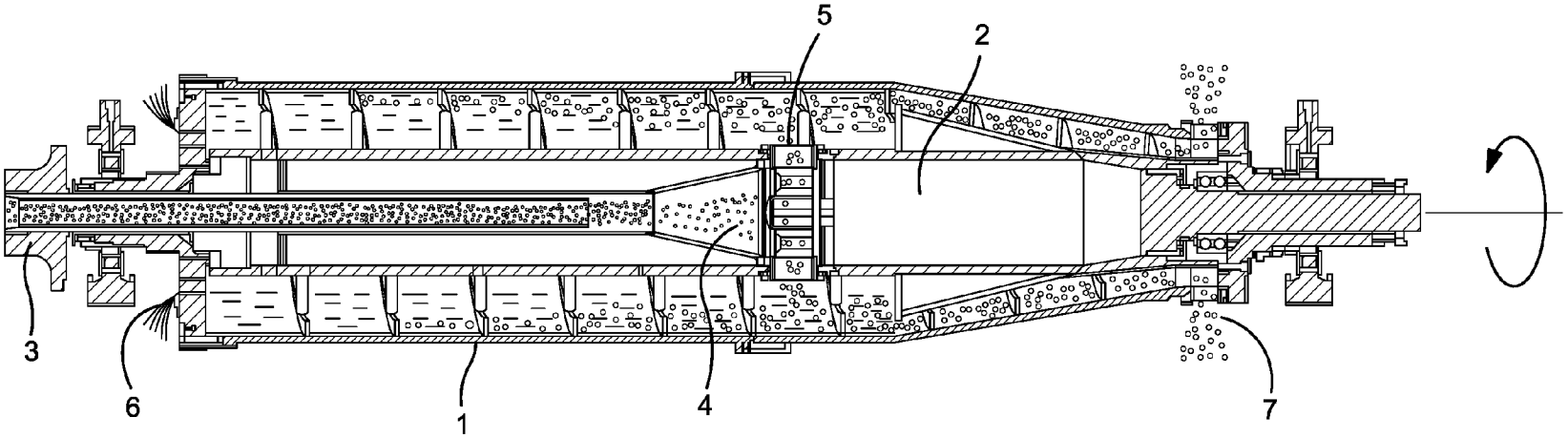
FIG. 1 shows a decanter centrifuge according to the invention.

FIG. 1 shows a decanter centrifuge including a bowl 1 with a high rotational speed for optimum phase separation, a scroll conveyor 2 for sludge conveyance and compacting, an axial feed 3, a feed chamber 4, mixture outlet 5, an outlet 6 for clear liquid phase and an outlet 7 for the recovery of the solid phase.

Figure 2:
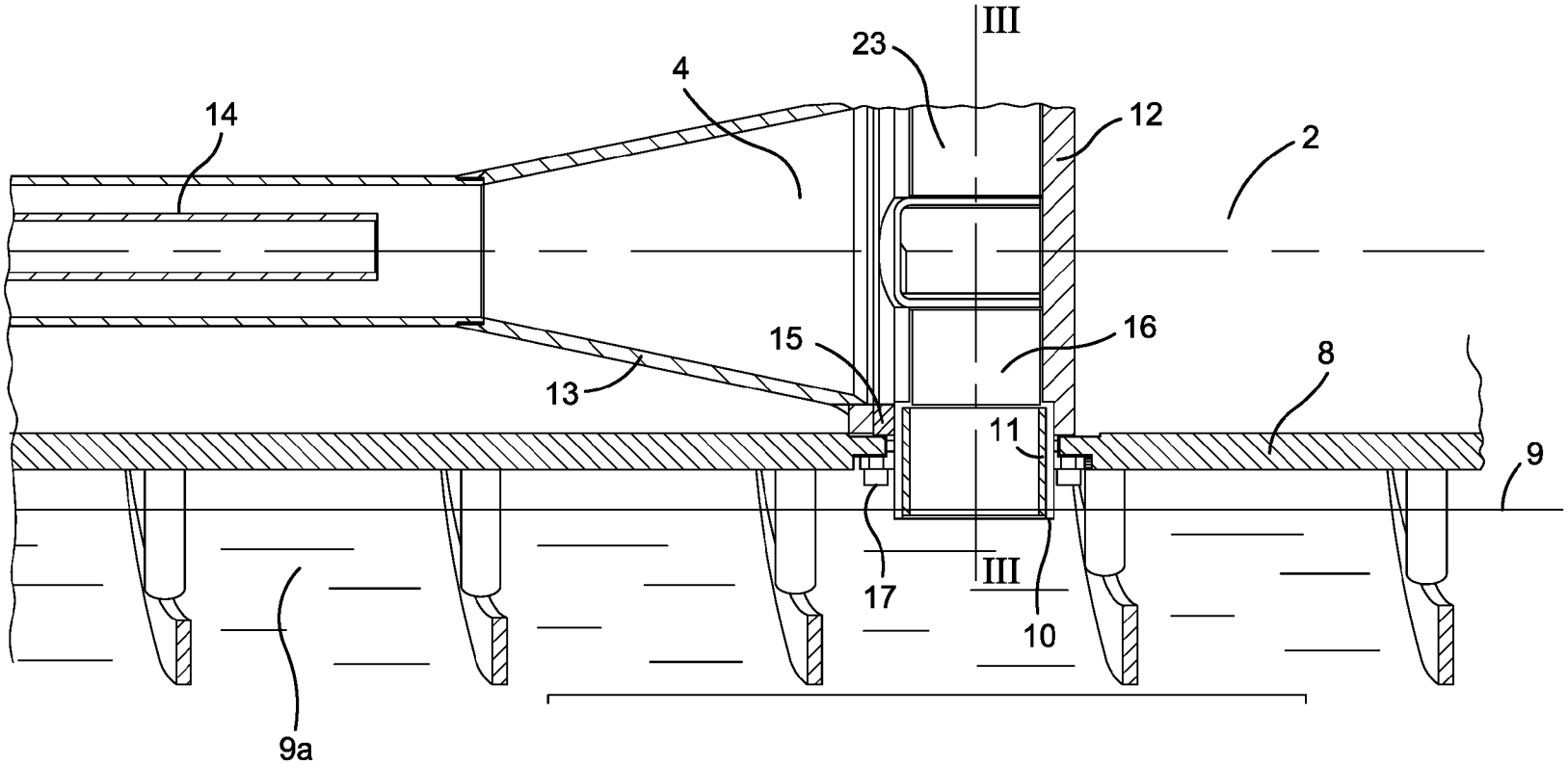
FIG. 2 shows a detail of FIG. 1 with the feed chamber according to the invention.

FIG. 2 shows a feed chamber 4 including an accelerating cone 13 that leads to a cylindrical distribution chamber 23 where a number of accelerator inserts 16 are arranged circumferentially between nozzles 10, and extend axially for at least most of the distance between the end wall 12 of the distribution chamber, and the accelerating cone 13, which is connected to the axial feed 3. This results in a new feed chamber 4 for the scroll 2 with high efficiency, smooth product acceleration, wear protection and easy maintenance.

The cross section of the nozzles 10 can be rectangular, oval or round or have any other shape. The outside extension of the nozzles is made up to pond level 9 in order to avoid discharge of the product in the pool 9*a* as a splash and to avoid air flow through the nozzles 10. This will avoid product re-suspension in the pool 9*a* in the region of the feed chamber 4 and air under pressure inside the machine, especially for the decanter centrifuges operating at high pond level (close to the scroll hub or submerged scroll conditions). The inner surface 11 of the nozzles 10 is protected with ceramics, tungsten carbide or any other wear resistant protection. The fixation of the nozzles is made with bolts 17, on the hub 8 of the scroll 2. The accelerator inserts 16 are made in polyurethane, stainless steel with wear resistant protection on inner surface or any wear resistant material. The sizes of these accelerator inserts 16 are such that it is possible to install them through the opening of scroll 2 before mounting the nozzles 10. The fixation of such accelerator inserts 16 is made in circumferential direction by the extension inside of two consecutives nozzles 10 inside the feed chamber 4 and axially by end wall 12 and fixation ring 15. This arrangement with nozzles 10 and accelerator inserts 16 offers the possibility to effect repairs of the scroll 2 directly on site in a short time.

The inside extension of the nozzles 10 is made up to the level of the accelerator inserts 16 in order to avoid high shear or stagnation flows inside the feed chamber 4.

Figure 3:
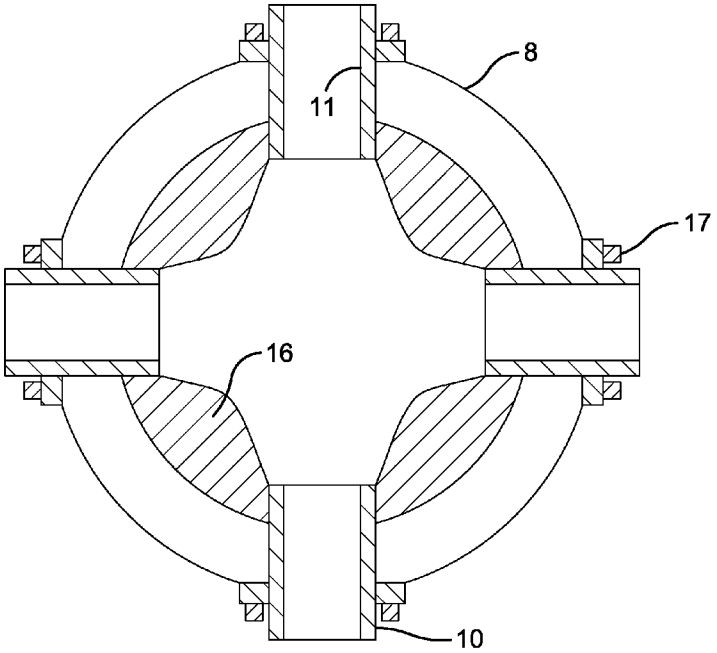
FIG. 3 shows a cross section along line III-III in FIG. 2.

FIG. 3 shows a cross section along line III-III in FIG. 2 through a feed chamber according to the invention. In this feed chamber there are arranged a number of accelerator inserts 16 which are held in place by the extensions of the nozzles 10 into the feed chamber. On the outside of the feed chamber the nozzles are fixed with bolts 17 to allow an easy and quick mounting and releasing for maintenance without dismantling the whole scroll 2. In the embodiment of FIG. 3 the nozzles 10 and accelerator inserts 16 are arranged symmetrically.

Figure 4:
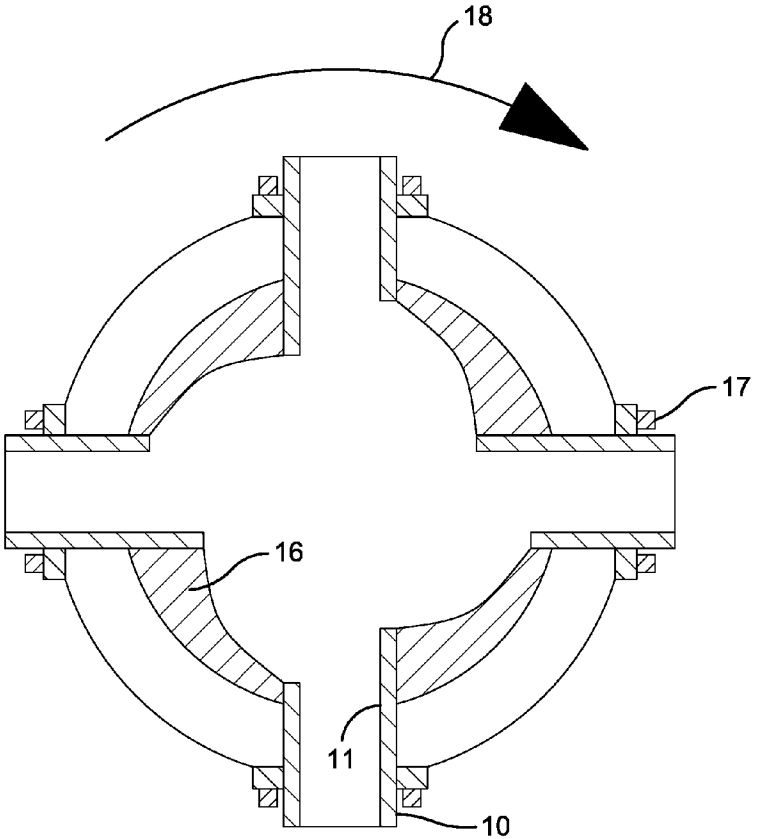
FIG. 4 shows an alternative embodiment of the invention analogue to FIG. 3

FIG. 4 shows another arrangement of accelerator inserts 16. Here the inserts have a non-symmetrical smooth surface. They are still arranged and fixed between the nozzles 10. To allow this, the nozzles 10 have a form where they extend into the feed chamber at different lengths corresponding to the accelerator inserts. This can be achieved more easily with a cross section of the nozzle 10 which is rectangular.

Figure 5:
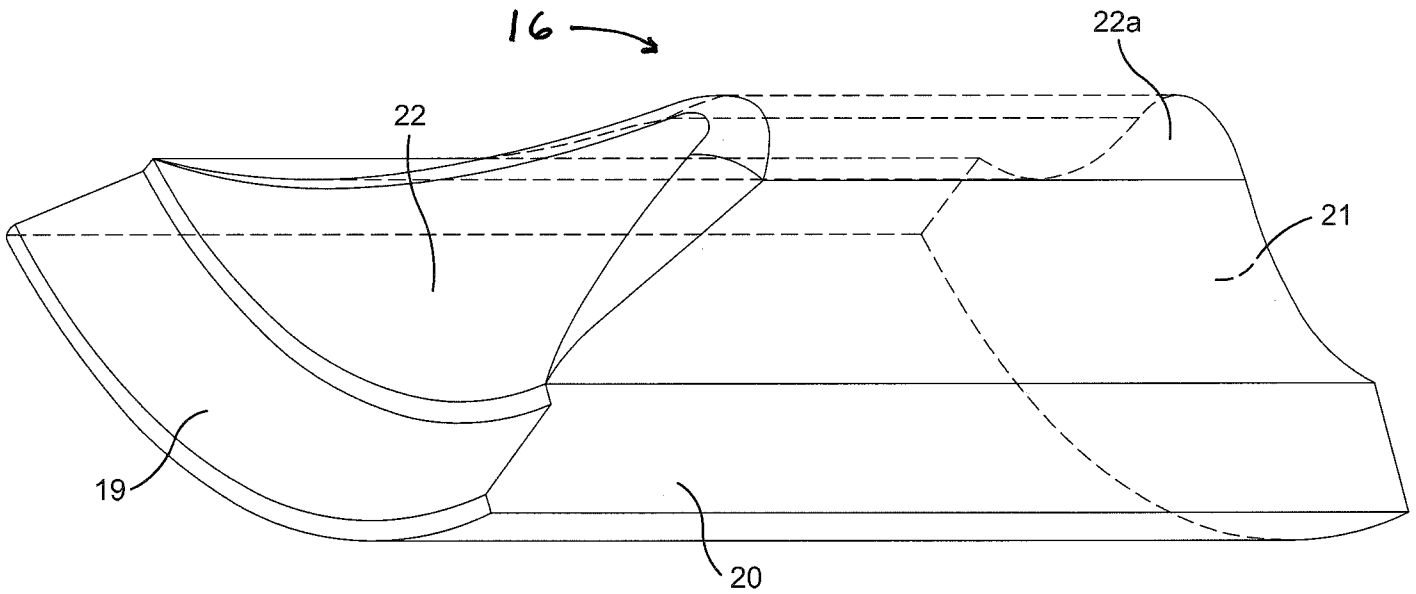
FIG. 5 shows an accelerator insert according to the invention.

FIG. 5 shows a detailed shape of an accelerator insert 16, where a progressive smooth surface 22 of a smooth vane 22*a* is made in order to avoid high shear of the product. The surface 19 is in contact with the fixation ring 15 and the surface 20 is in contact with the inner extension of the nozzles. Further the surface 21 is in contact with end wall 12 of the feed chamber 4.

The invention is not limited to the embodiments of the drawings but seen in the scope of the claims. Especially the form of the accelerator inserts can be different from the ones shown and the material of the accelerator inserts and nozzles can be different from the ones presented.

The invention claimed is:

1. A decanter centrifuge comprising:

a rotatable bowl extending along a centrifuge axis of rotation;

a rotatable scroll conveyor mounted coaxially within the bowl, said scroll conveyor including a hub, a hub inside surface, a hub outside surface, and a helical winding along the outside surface;

a feed pipe passing centrally within the hub and leading into a feed chamber within the hub;

a plurality of circumferentially spaced apart nozzles extending radially outward from a round internal wall of the feed chamber to the outside surface of the hub and extending radially inward beyond the internal wall of the feed chamber;

a plurality of discrete accelerator inserts mounted on the internal wall of the feed chamber, wherein each insert is adjacently mounted between two nozzles; and each insert is circumferentially fixed by abutment with the radially inward extensions of two of said spaced apart nozzles.

2. The decanter centrifuge of claim 1, wherein the feed chamber includes a conical acceleration chamber followed by a cylindrical distribution chamber having an axial length defined between an entry opening and an end wall;

the nozzles and inserts are located in the distribution chamber;

each insert has a length that is at least most of the axial length of the distribution chamber; and the inserts are fixed axially by abutment against a fixation ring around the entry opening and engagement with the end wall.

3. The decanter centrifuge of claim 1, wherein each insert is mounted between the feed pipe and the nozzles such that all flow from the feed pipe to the nozzles passes along an internal surface of an insert.

4. The decanter centrifuge of claim 3, wherein the internal surface of each insert is curved.

5. The decanter centrifuge of claim 4, wherein the curved surface of each insert is wavy.

6. The decanter centrifuge of claim 1, wherein the nozzles are fixed on the hub with bolts.

7. The decanter centrifuge of claim 1, wherein the nozzles are exchangeable.

8. The decanter centrifuge of claim 1, wherein the accelerator inserts are exchangeable.

9. The decanter centrifuge of claim 1, wherein the inserts are made from one of polyurethane or stainless steel with a wear resistant surface.

10. A decanter centrifuge comprising:

a rotatable bowl extending along a centrifuge axis of rotation;

a rotatable scroll conveyor mounted coaxially within the bowl, said scroll conveyor including a hub, a hub inside surface, a hub outside surface, and a helical winding along the outside surface;

a feed pipe passing centrally within the hub and leading into a feed chamber within the hub;

a plurality of nozzles extending radially outward from an internal wall of the feed chamber to the outside surface of the hub; and a plurality of inserts mounted on the internal wall of the feed chamber, with each insert adjacently mounted between two nozzles;

wherein the feed chamber includes an acceleration cone that opens into a distribution chamber;

the distribution chamber has an axial length;

each insert has a length that spans at least most of the length of the distribution chamber;

each nozzle has a flow inlet that spans at least most of the length of the distribution chamber; and each insert is mounted between the acceleration cone and the nozzles such that all flow from the acceleration cone to the nozzles passes along an internal surface of an insert.

11. The decanter centrifuge of claim 10, wherein the internal surface of each insert has a wave shape.

12. In a decanter centrifuge including a rotatable scroll conveyor with a hub and at least one helical winding, the hub including a feed chamber having an inside surface and an outside surface, and a feed pipe in the center of the hub leading to the feed chamber, the improved feed chamber comprising a plurality of nozzles spaced circumferentially in and extending from inside to outside of the feed chamber; discrete accelerator inserts provided on the inside surface of the feed chamber circumferentially between the nozzles; and each said insert is circumferentially fixed by abutment with the radially inward extensions of two of said spaced apart nozzles.

13. The feed chamber of claim 12, wherein the nozzles are fixed on the hub of the scroll conveyor with bolts.

14. The feed chamber of claim 12, wherein the nozzles are exchangeable.

15. The feed chamber of claim 12, wherein the accelerator inserts are exchangeable.

16. The feed chamber of claim 12, wherein the accelerator inserts have a wave shaped form.

17. The feed chamber of claim 12, wherein the accelerator inserts are made from one of polyurethane or stainless steel with a wear resistant surface.

* * * * *